United States Patent [19]

Rivera

[11] 4,002,181

[45] Jan. 11, 1977

[54] TRAVELING DENTURE TOOTHBRUSH DEVICE

[75] Inventor: Richard Rivera, Vallejo, Calif.

[73] Assignee: Lawrence Peska Associates, Inc., New York, N.Y.

[22] Filed: Aug. 4, 1975

[21] Appl. No.: 601,620

[52] U.S. Cl. ..... 132/84 D

[51] Int. Cl.[2] ..... A45D 44/18

[58] Field of Search ..... 132/84 D, 88.5, 88.7, 132/112, 116; 401/99

[56] References Cited

UNITED STATES PATENTS

| | | | |
|---|---|---|---|
| 2,180,533 | 11/1939 | Leffler | 132/88.7 UX |
| 2,401,318 | 6/1946 | Robinson et al. | 132/84 D |
| 3,059,652 | 10/1962 | Thomas | 132/112 |

*Primary Examiner*—G.E. McNeill

[57] ABSTRACT

A toothbrush used as a traveling denture cleaner device includes a casing having a right and left compartment therein and an open top. An elongated stem has bristles affixed at one end thereof and a bore extending from another end of the stem to the bristles of the stem. The other end of the stem is affixed onto a cap member which detachably secures to the open end of the case, wherein a liquid denture solution is transferred from one of the compartments through the bore to the bristles of the toothbrush.

3 Claims, 2 Drawing Figures

TRAVELING DENTURE TOOTHBRUSH DEVICE

BACKGROUND OF THE INVENTION

U.S. Pat. No. 1,380,246 to Peters et al., relates to a toothbrush container having a plunger for pushing outwardly a tooth paste from a container.

U.S. Pat. No. 1,849,769 to Priest teaches a tooth cleaning and polishing kit which includes a cleaner, a polisher, mirrors, and a dental floss supply.

U.S. Pat. No. 1,164,597 to Darling relates to a toothbrush detachably securing to a tube of tooth paste.

U.S. Pat. No. 1,062,961 to Funcke teaches a combined toothbrush and prophylactic container.

The aforementioned patents are non-applicable to my present invention which provides a means of storing a toothbrush and a denture solution in a single case.

SUMMARY OF THE INVENTION

My present invention relates to a unique and novel traveling denture toothbrush.

An object of my present invention is to provide a toothbrush, wherein the toothbrush and a denture cleaning solution are both stored in one case, wherein the toothbrush can be affixed to an open end of the case thereby permitting transferring of the cleaning solution from the case through a bore in the stem to the bristles of the toothbrush.

Briefly, my present invention comprises a casing having a right and left compartment therein and an open top. An elongated stem has bristles affixed at one end thereof and a bore extending from another end of the stem to the bristles of the stem. The other end of the stem is affixed onto a cap member which detachably secures to the open end of the case, wherein a liquid denture solution is transferred from one of the compartments through the bore to the bristles of the toothbrush.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
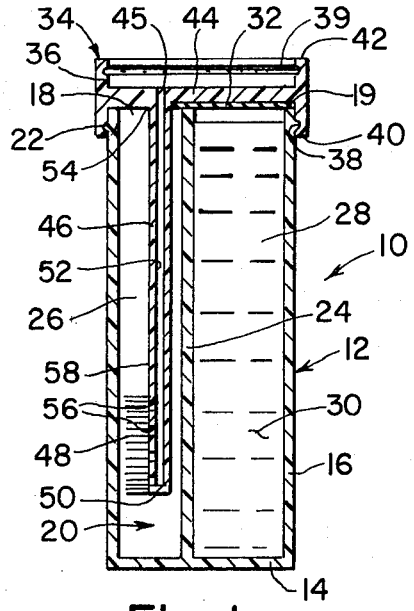
FIG. 1 illustrates a side cross sectional view of a traveling denture cleaner having a stem with affixed bristles thereon positioned within a chamber of a case of the device.

Turning now descriptively to the drawings, in which similar reference characters denote similar elements throughout the several views, FIG. 1 show a toothbrush 10 which can be used as traveling denture cleaner device. The toothbrush 10 comprises a cylindrically shaped case 12 having a closed base 14, a cylindrically shaped upwardly extending side wall 16, an open top 18 and an interior chamber 20 therein. An annular lip 22 is contained on the sidewall 16 disposed towards the upper end 19. A longitudinal intermediate wall 24 is affixed to the inside periphery of the sidewall 16 as well as the base 14 thereby dividing the chamber into a left 26 and right 28 compartment. The right compartment 28 is adapted to receive therein a liquid denture solution 30. A rubber gasket 32 is affixed onto the upper end of wall 24 and a portion of the upper end 19 of sidewall 16 corresponding to the right compartment 28. A cap member 34 communicates with the upper end 19 of the sidewall 16 of the case 12. The cap member 34 comprises a cylindrically shaped sleeve 36 having annular apertures 38, 39 on the inside periphery at each end 40, 42 thereof. A disc member 44 is contained within sleeve 36, wherein the disc is affixed to the median periphery of the sleeve 36. Disc member 44 has a hole 45 therethrough. An elongated stem 46 has a plurality of bristles 48 at one end 50 thereof. The stem 46 has an elongated longitudinal bore 52 therein, wherein bore 52 extends from another end 54 of stem 46 to the bristle portion of the stem 46. A plurality of openings 56 extend between the bore 52 and the upper surface 56 of stem 46 within the bristles 48. The other end 54 of stem 46 is affixed onto disc member 44 such that hole 45 communicates with bore 52. In FIG. 1, the stem 46 extends down into the left compartment 26 as cap member 34 is detachably affixed to the upper end 19 of the case 12, wherein lip 22 engages into one of the apertures 38.

Figure 2:
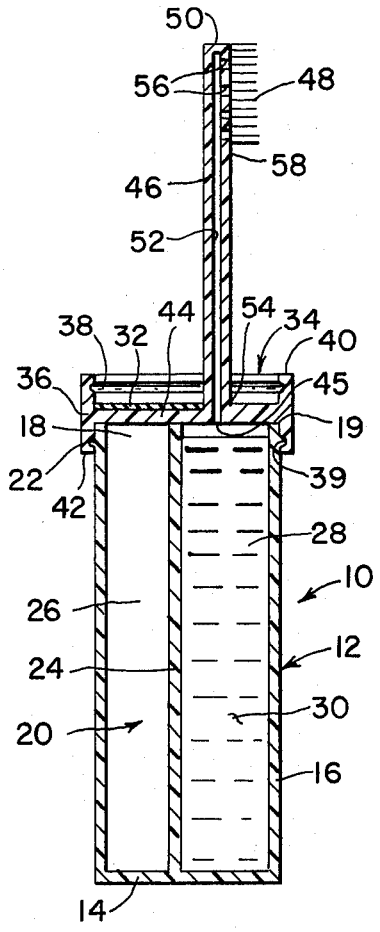
FIG. 2 illustrates a side cross sectional view of the device, wherein the stem extending linearly outward from the case.

In FIG. 2, the cap 34 is affixed onto the upper end of the case 12, wherein lip 22 engages into the other aperture 39 such that stem 46 extends linearly outward from the case 12. The liquid denture solution 30 is transported from the right compartment 28 through the bore 52 to the bristles 48. The case 12 functions as a handle for the toothbrush 10. The case 12 of the device 12 is formed from a flexible rubber or plastic like material such as an ethylene vinyl acetate, low density polyethylene or a flexible polyvinyl chloride.

Since obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United States is:

1. A toothbrush, which comprises:

a. a cylindrically shaped case having a sidewall, a closed base, an open top end and an interior chamber therein;

b. a longitudinal intermediate wall contained in said interior chamber, said intermediate wall dividing said chamber into a left and a right compartment;

c. an annular lip contained on an outside periphery of said sidewall at said top end thereof;

d. an elongated stem;

e. a plurality of bristles affixed at one end of said stem, said stem having a bore extending from another end of said stem to a bristle portion of said stem, and said stem having a plurality of openings extending between said bore and an upper surface of said stem within said bristles; and f. a cap member detachably affixing to said top end of said case, said other end of said stem affixed to said cap, said cap including a cylindrically shaped sleeve, an inside periphery of said sleeve having a pair of annular apertures therein, one said annular aperture disposed towards each end of said sleeve, said lip engaging into either of said two annular apertures and a disc member having a hole therethrough, said disc affixed to said inside periphery of said sleeve, said disc member having a hole therethrough, and said other end of said stem affixed to said disc member at said hole.

2. A toothbrush according to claim 1, wherein said right chamber is adapted to receive a denture solution therein.

3. A toothbrush according to claim 1, wherein said toothbrush further includes a rubber gasket affixed onto an upper end of said intermediate wall and said sidewall of said case.

* * * * *